US011607893B2

(12) United States Patent
Chino

(10) Patent No.: US 11,607,893 B2
(45) Date of Patent: Mar. 21, 2023

(54) RECORDING DEVICE

(71) Applicant: Seiko Epson Corporation, Tokyo (JP)

(72) Inventor: Toru Chino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 17/472,986

(22) Filed: Sep. 13, 2021

(65) Prior Publication Data

US 2022/0080750 A1 Mar. 17, 2022

(30) Foreign Application Priority Data

Sep. 14, 2020 (JP) ..... JP2020-153573

(51) Int. Cl.
*B41J 11/00* (2006.01)

(52) U.S. Cl.
CPC ..... *B41J 11/0022* (2021.01)

(58) Field of Classification Search
CPC ..... B41J 11/0022; B41J 2/01
See application file for complete search history.

(56) References Cited

U.S. PATENT DOCUMENTS 10,328,719 B2 * 6/2019 Kobashi ..... B41J 2/16508

FOREIGN PATENT DOCUMENTS

JP 2015-063382 4/2015
JP 2019-171639 10/2019

* cited by examiner

*Primary Examiner* — Bradley W Thies
(74) *Attorney, Agent, or Firm* — Workman Nydegger

(57) ABSTRACT

A recording device includes a transport unit configured to transport a recording medium in a transport direction along a transport path, a recording unit configured to discharge ink onto the recording medium that is transported while making a scanning movement in a width direction that intersects with the transport direction, to perform recording, a standby unit at which the recording unit stands by in a non-recording state, and a drying mechanism including a heat source and an air blowing unit, and configured to blow hot air to a recording surface of the recording medium on which the recording was performed and transported downstream of the recording unit in the transport path, and the heat source is arranged at one end side in the width direction, and the standby unit is arranged at the other end side in the width direction.

10 Claims, 3 Drawing Sheets

RECORDING DEVICE

The present application is based on, and claims priority from JP Application Serial Number 2020-153573, filed Sep. 14, 2020, the disclosure of which is hereby incorporated by reference herein in its entirety.

BACKGROUND

1. Technical Field

The present disclosure relates to a recording device that performs recording by applying liquid onto a recording medium.

2. Related Art

Typically, for example, a recording device provided with a drying unit for drying ink applied onto a recording medium, such as an image forming device illustrated in JP-A-2019-171639, is known. JP-A-2019-171639 states that specific drying units include an infrared heater, a hot air heater, a heating roller, and a hot plate, and the like.

However, depending on the configuration of the recording device and the specifications of the liquid such as the ink that is used, there is a problem in that, since the heat emitted from the heat source of the drying unit is transferred to the liquid before being applied to the recording medium, the discharge characteristics of the liquid discharging head that applies the liquid thereto is affected, so that the recording quality may be deteriorated.

SUMMARY

A recording device according to the present disclosure includes a transport unit configured to transport a recording medium in a transport direction along a transport path, a recording unit configured to discharge liquid onto the recording medium that is transported while making a scanning movement in a width direction that intersects with the transport direction, to perform recording, a standby unit at which the recording unit stands by in a non-recording state, and a drying mechanism including a heat source and an air blowing unit, and configured to blow hot air to a recording surface of the recording medium on which the recording was performed and transported downstream of the recording unit in the transport path, and the heat source is arranged at one end side in the width direction, and the standby unit is arranged at the other end side in the width direction.

DESCRIPTION OF EXEMPLARY EMBODIMENTS

1. First Exemplary Embodiment

Figure 1:
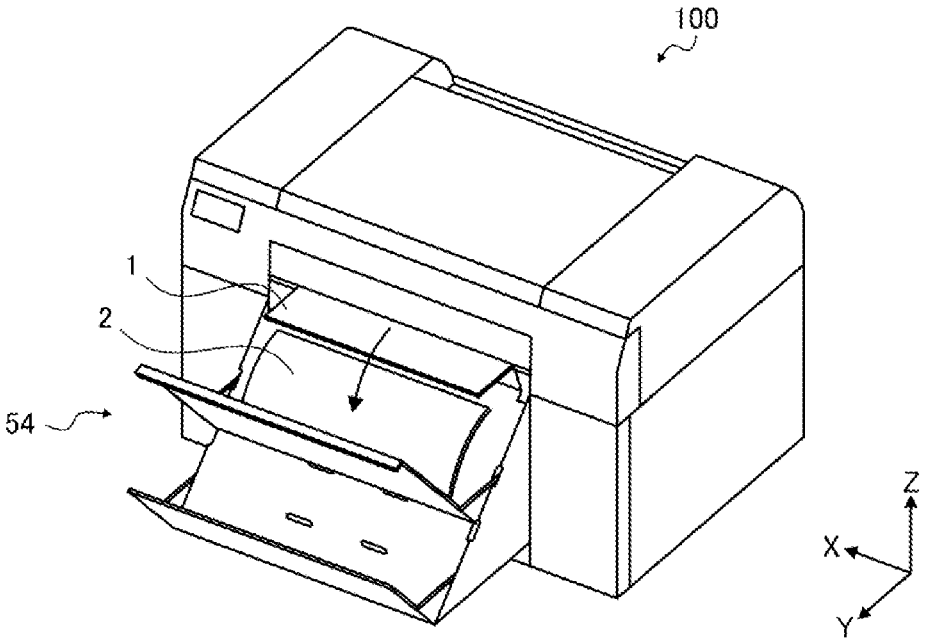
FIG. 1 is a perspective view of a recording device according to a first exemplary embodiment.
Figure 2:
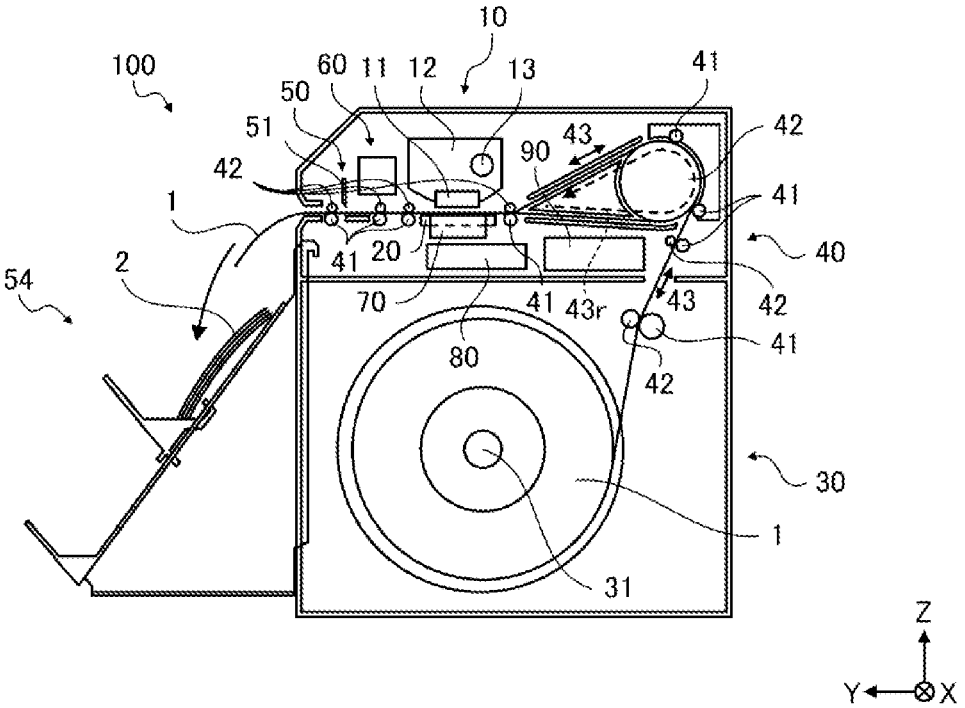
FIG. 2 is a configuration diagram of the recording device according to the first exemplary embodiment when viewed from a side.

The configuration of a recording device 100 according to a first embodiment will be described with reference to FIGS. 1 to 4.

In addition, in the coordinates in the drawings, the Z-axis direction is the vertical direction, the +Z direction is the up direction, the Y-axis direction is the front-rear direction, the +Y direction is the forward direction, the X-axis direction is the left-right direction, the +X direction is the left direction, and the X-Y plane is the horizontal plane. Further, in the present embodiment, the X-axis direction is the width direction of the recording device 100.

The recording device 100 is an ink jet-type printer that discharges ink as liquid onto a recording medium 1 supplied in a roll state to perform printing, based on print data and recording specifications received from an external electronic apparatus or external storage medium such as a personal computer connected thereto.

The recording device 100 includes a recording unit 10, a support unit 20, a supply unit 30, a transport unit 40, a cutting unit 50, a drying mechanism 60, a standby unit 70, an ink storage unit 80 as a liquid storage unit, a control unit 90, and the like.

The recording unit 10 includes a recording head 11, a carriage 12, a guide shaft 13, a carriage motor, and the like. The carriage motor is not illustrated.

The recording head 11 includes a plurality of nozzles that discharge ink for recording as ink droplets. The recording head 11 is mounted on the carriage 12, and along with the carriage 12 that reciprocates in the X-axis direction, the recording head 11 scans and moves in the X-axis direction, that is, in the width direction of the recording device 100.

The guide shaft 13 extends in the X-axis direction and supports the carriage 12 in a slidable contact state. The carriage motor serves as a driving source when reciprocating the carriage 12 along the guide shaft 13.

By the control of the control unit 90, the recording device 100 repeatedly performs an operation of discharging ink droplets from the recording head 11 while moving the carriage 12 on which the printing head 11 is mounted along the guide shaft 13, and an operation of moving the recording medium 1 in the transport direction, so that a desired image is recorded on the recording medium 1. Here, when a region where ink droplets are discharged from the recording head 11 and recording on the recording medium 1 is performed is referred to as a recording region, the transport direction of the recording medium 1 in the recording region is the Y-axis direction that intersects the X-axis direction in which the recording head 11 scans and moves.

Examples of the ink include a four color ink set, as an ink set of dark ink compositions, obtained by adding black to a three color ink set including cyan, magenta, and yellow. Examples of the ink also include an eight color ink set obtained by adding an ink set of light ink compositions, such as light cyan, light magenta, light yellow, and light black, with reduced concentrations of the respective color materials.

As a suitable example of a method of discharging ink droplets, a piezo method is used. The piezo method is a method of recording by using a piezo element that is a piezoelectric element to apply a pressure corresponding to a recording information signal to the ink stored in a pressure chamber, and thus jetting ink droplets from nozzles communicated with the pressure chamber.

Note that the technique of discharging ink droplets is not limited to the piezo method and may be any other recording technique of ejecting ink in a form of droplets and forming a dot group on a recording medium.

The support unit 20 is a plate-like body that faces the recording head 11 and supports the recording medium 1 transported in the transport direction from below in the recording region. The support unit 20 may include an intake hole that adsorbs the recording medium 1 to a support face supporting the recording medium 1 in order to suppress floating of the recording medium 1.

The supply unit 30 can accommodate the recording medium 1 that is in a roll shape. The supply unit 30 includes a support shaft 31 that rotatably supports the roll-shaped recording medium 1. The support shaft 31 is capable of feeding out and winding the recording medium 1 in accordance with the drive of the transport unit 40, by a driving motor driven under the control of the control unit 90. The driving motor is not illustrated.

The transport unit 40 includes a plurality of transport rollers 41, and transports the recording medium 1 in the transport direction along a transport path 43. The transport roller 41 is a driving roller driven and controlled by the control unit 90, and a driven roller 42 that rotates with the rotation of the transport roller 41 with the recording medium 1 sandwiched between the transport roller 41 and the driven roller 42 may be provided.

The transport path 43 is configured to include an inversion path 43*r* that inverts the recording medium 1, in addition to a forward path that sequentially feeds the recording medium 1 from the supply unit 30 to the recording unit 10, and the cutting unit 50.

A specific example of the transport path 43 will be described with reference to FIG. 3. Here, the transport rollers 41 that transport the recording medium 1 from the supply unit 30 to the recording unit 10 and the cutting unit 50 in this order and discharge the recording medium 1 from the cutting unit 50 are referred to as transport rollers 41*a* to 41*h*. Further, the driven rollers 42 that is driven by the transport rollers 41*a*, 41*b*, and 41*e* to 41*h* are referred to as driven rollers 42*a*, 42*b*, and 42*e* to 42*h*, respectively, and the driven rollers 42 that is driven by the transport rollers 41*c* and 41*d* are referred to as a driven roller 42*cd*.

The transport roller 41*a* is the transport roller 41 that feeds the recording medium 1 from the supply unit 30 toward the transport roller 41*b*.

The transport roller 41*b* is the transport roller 41 that feeds the recording medium 1 toward the transport roller 41*c*, and sandwiches the recording medium 1 between the transport roller 41*b* and the driven roller 42*b*. When the inversion path 43*r* is transported in order to invert the recording medium 1 of the leading side cut by the cutting unit 50, the transport roller 41*b* can allow a tip portion of the recording medium 1 of the trailing side that has been cut and rewound to stand by.

The transport rollers 41*c* and 41*d* are the transport rollers 41 that transport the recording medium 1 transported from the supply unit 30, and the recording medium 1 that is inverted and transported. The driven roller 42*cd* is the driven roller 42 that sandwiches the recording medium 1 between the driven roller 42*cd* and two transport rollers 41*c* and 41*d*, and rotates in accordance with the transport rollers 41*c* and 41*d*. Since the driven roller 42*cd* constitutes the inversion path 43*r* for inverting the recording medium 1, the driven roller 42*cd* is constituted by a roller having a diameter larger than that of the other driven rollers 42.

The transport roller 41*d* is the transport roller 41 that feeds the recording medium 1 toward the transport roller 41*e*.

The transport roller 41*e* is the transport roller 41 that sandwiches the recording medium 1 between transport roller 41*e* and the driven roller 42*e* and transports the recording medium 1 upstream of the support unit 20.

The transport roller 41*f* is the transport roller 41 that sandwiches the recording medium 1 between the transport roller 42*f* and the driven roller 41*f* and transports the recording medium 1 downstream of the support unit 20.

The transport roller 41*g* is the transport roller 41 that sandwiches the recording medium 1 between the transport roller 41*g* and the driven roller 42*g* and transports the recording medium 1 upstream of the cutting unit 50.

The transport roller 41*h* is the transport roller 41 that sandwiches the recording medium 1 between the transport roller 41*h* and the driven roller 42*h* and transports the recording medium 1 downstream of the cutting unit 50. The transport roller 41*h* can hold the recording medium 1 of the leading side that has been cut by the cutting unit 50, that is, can hold a recorded matter 2 with one recording surface on which recording has been completed and cut, or can discharge the recorded matter 2 that has been cut and recorded.

The cutting unit 50 includes a cutter 51 or the like, and under the control of the control unit 90, the cutting unit 50 cuts the recording medium 1 on which recording has been completed, and when the recording medium 1 is not held by the transport roller 41*h*, the cutting unit 50 discharges recorded matter 2 that has been cut to a stacker 54.

The stacker 54 is provided on the front face of the recording device 100, and can stack and store the recorded matter 2 discharged from the cutting unit 50.

Figure 3:
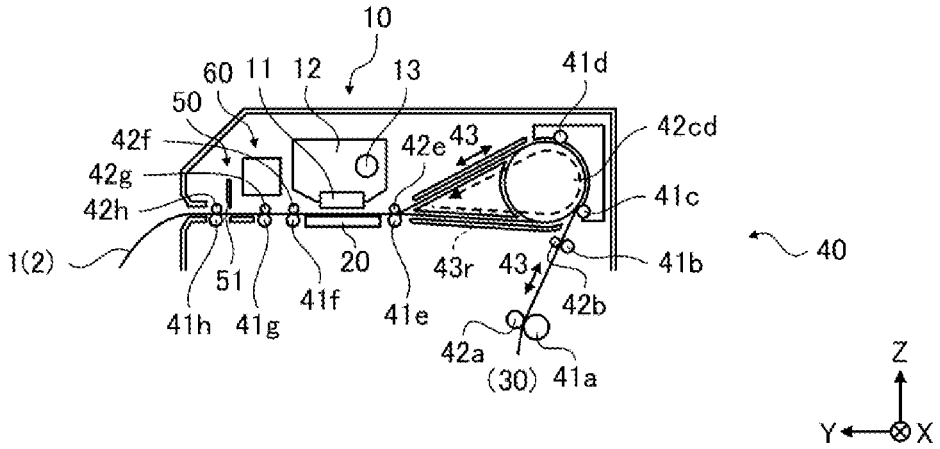
FIG. 3 is a side view illustrating a transport path.

With respect to the forward path in which the recording medium 1 is sequentially transported in the direction from the transport roller 41*c* to the transport roller 41*d* and the transport roller 41*e* with the leading side of the recording medium 1 forward, the inversion path 43*r* is a path to transport the recording medium 1 from the transport roller 41*e* to the transport roller 41*c* and the transport roller 41*d* and to return the recording medium 1 to the transport roller 41*e* with the trailing side of the recording medium 1 that has been cut forward, as illustrated in the direction of a dashed line arrow in FIG. 3. That is, the inversion path 43*r* is a path in which the leading side and the trailing side of the recording medium 1 are transported in reverse.

In other words, the recording device 100 includes the inversion path 43*r* capable of inverting the recording medium 1 upstream of the recording unit 10 in the transport path 43.

When inverting the recorded matter 2 and performing recording on the back surface thereof without discharging the recorded matter 2 to the stacker 54, first, under the control of the control unit 90, the recording medium 1 at the trailing side that has been cut is rewound so that a tip portion thereof comes to the transport roller 41*b*, by inverting the transport rollers 41*a* to 41*g*. Then, the recorded matter 2 held by the transport roller 41*h* is transported to the transport roller 41*c* via the inversion path 43*r*, by inverting the transport rollers 41*h*, 41*g*, 41*f*, and 41*e*. Next, the recorded matter 2 is transported while rotating the transport rollers 41*c* to 41*h* in the forward direction, and recording is performed on the back surface of the recording matter 2 at the recording unit 10.

Figure 4:
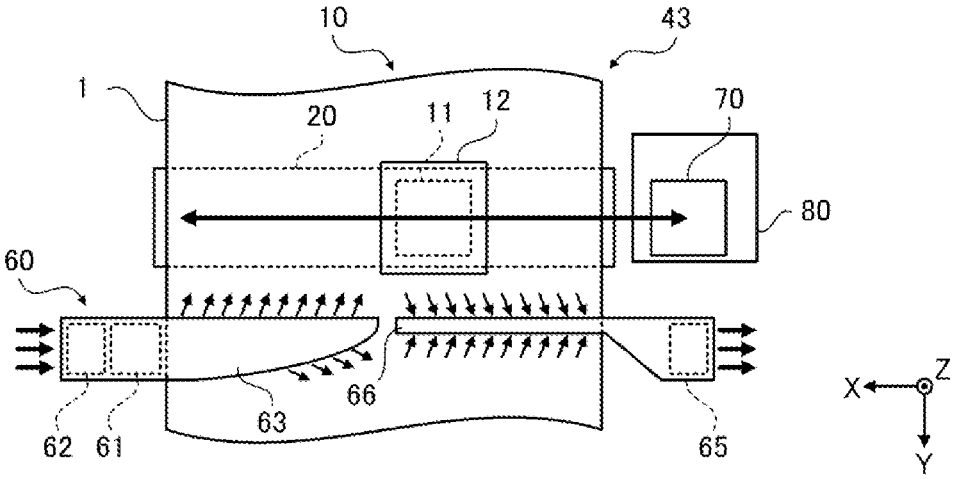
FIG. 4 is a plan view illustrating a configuration of the recording device according to the first exemplary embodiment.

As illustrated in FIG. 4, the drying mechanism 60 includes a heat source 61 and an air blowing unit 62, and dries the recording medium 1 by blowing hot air onto the recording surface of the recorded recording medium 1 that is transported downstream of the recording unit 10 in the transport path 43.

The heat source 61 is arranged at the +X side, which is one end side in the width direction of the recording device 100, and the standby unit 70 is arranged at the −X side, which is the opposite side, that is, the other end side in the width direction of the recording device 100. Further, the heat source 61 is arranged outside the transport path 43 in the width direction of the recording device 100, and the air blowing unit 62 is arranged further outside the heat source 61 in the width direction.

Note that it is not necessary to arrange the heat source 61 at a position opposing to the standby unit 70 in the X-axis direction, and the heat source 61 may be provided at the opposite side to the side where the standby unit 70 is provided, with the transport path 43 interposed therebetween. Further, when the heat source 61 is provided at the opposite side to the side where the standby unit 70 is provided, with the transport path 43 interposed therebetween, each of the heat source 61 and the standby unit 70 may be arranged at a position opposite to the example illustrated in FIG. 4. That is, the heat source 61 may be arranged at the −X side in the width direction of the recording device 100, and the standby unit 70 may be arranged at the +X side, which is the opposite side thereof.

As a preferable example, a PTC heater having excellent self-temperature control is used for the heat source 61. Here, PTC means Positive Temperature Coefficient. As a preferable example, an air blowing fan is used for the air blowing unit 62.

Further, as illustrated in FIG. 4, the drying mechanism 60 includes an air blowing duct 63 that communicates with the air blowing unit 62 and extends over the transport path 43, and blows hot air onto the recording surface. The heat source 61 is provided inside the air blowing duct 63, and the air blown by the air blowing unit 62 passes through the heat source 61 and is applied to the recording surface of the recording medium 1 from the air blowing duct 63 as hot air.

The air blowing duct 63 extends in a shape that tapers from the one end side, that is, the +X side, to the center of the transport path 43 so that hot air is applied to the recording surface of the recording medium 1 that is transported downstream of the recording region. A discharge port of hot air is provided below the air blowing duct 63 that extends on the transport path 43, and the hot air is blown in the direction of the recording medium 1.

Since the air blowing duct 63 has a tapered shape, the speed of the hot air sent out from the air blowing duct 63 becomes faster as it approaches the tip. That is, the air blowing duct 63 is configured to be able to effectively dry even in a range away from the heat source 61.

Further, at a position opposing to the air blowing unit 62 at outside of the transport path 43 in the width direction of the recording device 100, that is, in the X-axis direction, an exhaust unit 65 that sucks air at the transport path 43 side and discharges the air is provided. The exhaust unit 65 is provided with an intake duct 66 that communicates with the exhaust unit 65 and extends over the transport path 43, and sucks the hot air applied to the recording surface of the recording medium 1.

The intake duct 66 extends from the other end side, that is, from the −X side, to the center of the transport path 43 so that the hot air sent from the air duct 63 can be sucked while being applied to the recording surface of the recording medium 1. The intake duct 66 extending to the transport path 43 is provided with an intake port of hot air, and sucks the hot air applied to the recording surface of the recording medium 1. The exhaust unit 65 discharges the sucked hot air to the outside of the recording device 100. That is, the hot air sent by the heat source 61 and the air blowing unit 62 flows from one end side to the other end side of the recording device 100 and is discharged.

The standby unit 70 constitutes a position where the recording unit 10 stands by in a non-recording state. The standby unit 70 has a maintenance function for maintaining the discharge function of the recording unit 10, and can perform maintenance of the recording head 11 by moving the recording head 11 to the standby position. Specifically, as a maintenance, for example, clogging of the nozzle included in the recording head 11 is eliminated, flushing to improve the discharge characteristics of the ink, and suction of the ink are performed. That is, the standby unit 70 has a function of collecting flushed ink, a function of sucking ink, and the like as maintenance functions. Further, as a maintenance function, the standby unit 70 may have a wiping function for wiping the ink adhering to the nozzle surface, and a cap function for capping the opening surface of the nozzle of the recording head 11 during non-recording to prevent the ink around the nozzle from drying.

The ink storage unit 80 includes a tank for storing ink. Ink is supplied from the ink storage unit 80 to the recording head 11 by an ink supply mechanism. The ink supply mechanism is constituted by an ink supply path such as a pipe in which the tank and the recording head 11 communicate with each other, an ink pump for supplying ink to the ink supply path, and the like. The ink supply mechanism is not illustrated.

The ink storage unit 80 is arranged at the other end side in the width direction of the recording device 100, that is, at the −X side. Specifically, as illustrated in FIG. 4, the ink storage unit 80 is arranged below the standby unit 70.

Note that the ink storage unit 80 may have a configuration including a cartridge holder capable of mounting an ink cartridge thereon instead of the tank for storing ink.

As illustrated in FIG. 3, the recording unit 10, the drying mechanism 60, and the inversion path 43*r* including the driven roller 42*cd*, in side view when arranged in the used state, are arranged at positions where at least a part of each of the recording unit 10, the drying mechanism 60, and the inversion path 43*r* overlap each other at the same height. Since the driven roller 42*cd* provided in the inversion path 43*r* for inverting and transporting the recording medium 1 is a roller having a large diameter, a large space is required in the height direction. In the height direction, the recording unit 10 and the drying mechanism 60 are arranged so that at least a part of each of the recording unit 10 and the drying mechanism 60 overlaps the space occupied by the driven roller 42*cd* at the same height.

The control unit 90 includes a CPU for performing calculations, a storage medium such as a RAM and a ROM, and performs centralized control of the entire recording device 100. Specifically, the control unit 90 controls the recording unit 10, the support unit 20, the supply unit 30, the transport unit 40, the cutting unit 50, the drying mechanism 60, and the like based on the received print data and recording specifications, and forms a desired recording image on the recording medium 1 to create the recorded matter 2.

According to the present embodiments, the following advantages can be obtained.

The recording device 100 includes the transport unit 40 configured to transport the recording medium 1 in the transport direction along the transport path 43, the recording unit 10 configured to discharge ink onto the recording medium 1 that is transported while making a scanning movement in the width direction that intersects with the transport direction, to perform recording, the standby unit 70 at which the recording unit 10 stands by in the non-recording state, and the drying mechanism 60 including the heat source 61 and the air blowing unit 62, and configured to blow hot air to the recording surface of the recording medium 1 on which the recording was performed and transported downstream of the recording unit 10 in the transport path 43. Further, the heat source 61 is arranged at one end side in the width direction, and the standby unit 70 is arranged at the other end side in the width direction. Since the heat source 61 is arranged at one end side in the width direction, and the standby unit 70 is arranged at the other end side in the width direction in the recording device 100, the heat emitted from the heat source 61 is less likely to be transmitted to the recording unit 10 that stands by at the standby unit 70 in the non-recording state. As a result, it is suppressed that the heat emitted from the heat source 61 affects the discharge characteristics of discharging ink, such as a change in the viscosity of the ink in the recording unit 10, and thus deterioration of recording quality is suppressed.

Further, the heat source 61 is arranged outside the transport path 43 in the width direction, and the air blowing unit 62 is arranged further outside the heat source 61 in the width direction. Since the heat source 61 is arranged at a position closer to the recording medium 1 in the transport path 43 than the air blowing unit 62, it is possible to more efficiently transfer heat to the recording medium 1, that is, to more efficiently dry the recording medium 1. Further, the air blowing unit 62 is arranged further outside the heat source 61, it is possible to prevent a side surface of the recording device 100 from being heated by the heat source 61.

Furthermore, the drying mechanism 60 includes the air blowing duct 63 that communicates with the air blowing unit 62 and extends over the transport path 43, and blows hot air onto the recording surface. The air blowing duct 63 that communicates with the air blowing unit 62 and blows hot air onto the recording surface is provided, so that the recording medium 1 can be more effectively dried. Further, since the hot air can be less likely to be dispersed in the recording device 100 by the air blowing duct 63, it is suppressed that the discharge characteristics of discharging ink is affected, such as a change in the viscosity of the ink in the recording unit 10 due to the heat of hot air, and thus deterioration of recording quality is suppressed.

Further, since the exhaust unit 65 that sucks air at the transport path 43 side and discharges the air is provided at a position opposing to the air blowing unit 62 in the width direction, the hot air applied to the recording surface of the recording medium 1 can be discharged to the outside of the recording device 100. As a result, it is suppressed that the heat emitted from the drying mechanism 60 affects the discharge characteristics of the recording unit 10, such as a change in the viscosity of the ink in the recording unit 10 due to the heat emitted from the drying mechanism 60, and thus deterioration of recording quality is suppressed.

Further, since the intake duct 66 that communicates with the exhaust unit 65 and extends over the transport path 43, and sucks hot air applied to the recording surface of the recording medium 1 is provided, the hot air is less likely to be dispersed in the recording device 100. As a result, it is suppressed that the discharge characteristics of discharging ink is affected, such as a change in the viscosity of the ink in the recording unit 10, due to the heat of hot air, and thus deterioration of recording quality is suppressed.

Further, since the heat source 61 is arranged at one end side in the width direction, and the ink storage unit 80 that stores ink is arranged at the other end side in the width direction in the recording device 100, the heat emitted from the heat source 61 is less likely to be transmitted to the ink storage unit 80. As a result, deterioration of the ink, such as a change of the viscosity of the ink stored in the ink storage unit 80 due to the heat emitted from the heat source 61, can be suppressed, and thus deterioration of recording quality is suppressed.

Further, the standby unit 70 has maintenance functions such as flushing, suction, and wiping functions for maintaining the discharge function of the recording unit 10, and the standby unit 70 is arranged at a position away from the heat source 61, so that the maintenance functions are suppressed from being affected by the heat from the heat source 61.

Further, the inversion path 43*r* capable of inverting the recording medium 1 upstream of the recording unit 10 in the transport path 43 is included, and the recording unit 10, the drying mechanism 60, and the inversion path 43*r* including the driven roller 42*cd*, in side view when arranged in the used state, are arranged at positions where at least a part of each of the recording unit 10, the drying mechanism 60, and the inversion path 43*r* each other at the same height. Therefore, the height of the recording device 100 can be configured to be more compact as compared with the case where each of the recording unit 10, the drying mechanism 60, and the inversion path 43*r* are arranged at different height positions.

Note that in the description of the transport path 43 of the recording medium 1, the transport rollers 41*c* and 41*d* are the drive rollers that are driven and controlled by the control unit 90, and the driven roller 42*cd* that has a large diameter for constituting the inversion path 43*r* is the driven roller that rotates in accordance with 41*c* and 41*d*. However, the driven roller 42*cd* that has a large diameter may be constituted by the drive roller that is driven and controlled by the control unit 90, and the transport rollers 41*c* and 41*d* may be constituted by the driven roller that rotates in accordance with the large diameter drive roller.

2. Second Exemplary Embodiment

As a second exemplary embodiment, a modification example of the first exemplary embodiment will be described. Further, the same constituents as those in the first exemplary embodiment are given the same reference signs, and redundant description of these constituents will be omitted.

Figure 5:
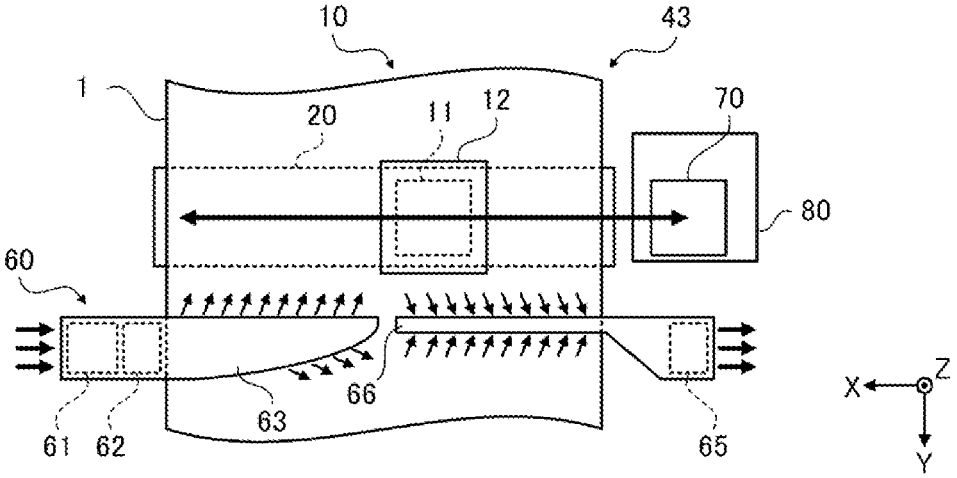
FIG. 5 is a plan view illustrating a configuration of a recording device according to a second exemplary embodiment.

In the description of the first exemplary embodiment, the heat source 61 is arranged outside the transport path 43 in the width direction of the recording device 100, that is, the X-axis direction, the and the air blowing unit 62 is arranged further outside the heat source 61 in the width direction, as illustrated in FIG. 4. However, the air blowing unit 62 may be arranged outside the transport path 43 in the width direction, and the heat source 61 may be arranged further outside the air blowing unit 62 in the width direction, as illustrated in FIG. 5.

According to the present embodiment, since the heat source 61 is arranged at a position away from the standby unit 70 with the air blowing unit 62 interposed therebetween, the heat generated by the heat source 61 is less likely to be transferred to the recording unit 10 that stands by at the standby unit 70 in the non-recording state. As a result, it is suppressed that the heat emitted from the heat source 61 affects the discharge characteristics of the recording unit 10, and thus deterioration of recording quality is suppressed.

3. Third Exemplary Embodiment

As a third exemplary embodiment, a modification example of the first exemplary embodiment will be described. Further, the same constituents as those in the first exemplary embodiment are given the same reference signs, and redundant description of these constituents will be omitted.

In the description of the first exemplary embodiment, as a preferable example, a PTC heater having excellent self-temperature control is used for the heat source 61, and the control of the work amount of the heat source was not described, in particular. The heat source 61 is not limited to such a PTC heater.

For example, the recording device 100 may be configured so that the output, as the work amount which is the drying capacity of the drying mechanism 60, can be controlled according to the amount of ink discharged to the recording medium 1.

By referencing the print data of the image to be printed, the control unit 90 is capable of determining the amount of ink to be discharged onto the recording medium 1. For example, if the amount of ink discharged onto the recording medium 1 is small, drying can be performed relatively easily, so that a high load is not required on the drying mechanism 60. On the contrary, when the amount of ink discharged onto the recording medium 1 is large, the load of work amount that can perform sufficient drying is required.

The control unit 90 of the present embodiment controls the drive of the heat source 61 and the air blowing unit 62 so that necessary and sufficient drying can be performed based on the information of the amount of ink obtained by referring to the print data. Specifically, as the amount of ink increases, the control unit 90 increases the amount of heat of the heat source 61 and the amount of air of the air blowing unit 62. That is, the recording device 100 controls the work amount of the drying mechanism 60 according to the amount of ink discharged onto the recording medium 1. Drive specifications of the heat source 61 and the air blowing unit 62 based on the amount of ink may be sufficiently evaluated and determined in advance by taking the temperature and humidity of printing environment into consideration.

According to the present embodiment, since the control unit 90 that controls the work amount of the drying mechanism 60 according to the amount of ink discharged onto the recording medium 1 is provided, the control of sending hot air necessary and sufficient for drying the recording medium 1 can be performed. As a result, the hot air is not sent out more than necessary, so that it is suppressed that the heat emitted from the drying mechanism 60 affects the discharge characteristics of the recording unit 10, such as a change in the viscosity of the ink in the recording unit 10 due to the heat emitted from the drying mechanism 60, and thus deterioration of recording quality is suppressed.

In the above-described embodiment, the recording medium 1 supplied in a rolled state is described as an example of the recording medium, but a recording medium of cut form type may also be used. When the cut form type recording medium is used, the supply unit includes a supply mechanism that includes a separator for supplying the recording medium to the recording unit 10 one by one. Further, the cutting unit 50 may not be provided.

What is claimed is:

1. A recording device comprising:

a transport unit configured to transport a recording medium in a transport direction along a transport path, a recording unit configured to discharge liquid onto the recording medium that is transported while making a scanning movement in a width direction that intersects with the transport direction, to perform recording, a standby unit at which the recording unit stands by in a non-recording state, and a drying mechanism including a heat source and an air blowing unit, and configured to blow hot air to a recording surface of the recording medium on which the recording was performed and transported downstream of the recording unit in the transport path, wherein the heat source is arranged at one end side in the width direction, and the standby unit is arranged at the other end side in the width direction.

2. The recording device according to claim 1, wherein the heat source is arranged outside the transport path in the width direction, and the air blowing unit is arranged further outside the heat source in the width direction.

3. The recording device according to claim 2, wherein the drying mechanism includes an air blowing duct that communicates with the air blowing unit and extends over the transport path, and blows hot air onto the recording surface.

4. The recording device according to claim 2, wherein an exhaust unit that sucks air at the transport path side and discharges the air is provided at a position opposing to the air blowing unit in the width direction.

5. The recording device according to claim 4, comprising:

an intake duct that communicates with the exhaust unit and extends over the transport path, and sucks the hot air applied to the recording surface.

6. The recording device according to claim 1, wherein the air blowing unit is arranged outside the transport path in the width direction, and the heat source is arranged further outside the air blowing unit in the width direction.

7. The recording device according to claim 1, comprising:

a liquid storage unit configured to store the liquid, wherein the liquid storage unit is arranged at the other end side in the width direction.

8. The recording device according to claim 1, wherein the standby unit has a maintenance function for maintaining a discharge function of the recording unit.

9. The recording device according to claim 1, comprising:

an inversion path configured to invert the recording medium and arranged upstream of the recording unit in the transport path, wherein the recording unit, the drying mechanism, and the inversion path, in side view when arranged in a used state, are arranged at positions where at least a part of each of the recording unit, the drying mechanism, and the inversion path overlap each other at the same height.

10. The recording device according to claim 1, comprising:

a control unit configured to control a work amount of the drying mechanism according to an amount of the liquid discharged onto the recording medium.

* * * * *